United States Patent [19]

Sherr et al.

[11] 4,011,598

[45] Mar. 15, 1977

[54] BATHING CAP

[76] Inventors: Kittie Anne Sherr, 197 Inwood Ave., Upper Montclair, N.J. 07043; Mirian Garabrant, 217 Montclair Ave., Montclair, N.J. 07042

[22] Filed: Aug. 15, 1975

[21] Appl. No.: 605,075

[52] U.S. Cl. ..... 2/68

[51] Int. Cl.[2] ..... A42B 1/12

[58] Field of Search ..... 2/68, 67, 3 R, 3 A, 2/3 B, 3 C, 171, 174, 183, 185 B, 197

[56] References Cited

UNITED STATES PATENTS

| | | | |
|---|---|---|---|
| 486,348 | 11/1892 | Mattson | 2/68 |
| 1,143,341 | 6/1915 | Whittaker | 2/68 |
| 2,524,463 | 10/1950 | Moore | 2/68 |

*Primary Examiner*—H. Hampton Hunter
*Attorney, Agent, or Firm*—Eugene Lieberstein

[57] ABSTRACT

A bathing cap having an outer protective water impervious covering and a detachable inner framework for providing a pressurized seal about the head of the wearer along a line conforming substantially to the hairline. The inner framework is composed of a plurality of substantially rigid but pliable strips, two of which form a primary seal about the head of the wearer with the remaining strips forming a support for maintaining such primary seal. The two strips forming the primary seal consist of a first strip arranged about the forehead and a second extending around the nape of the neck.

8 Claims, 3 Drawing Figures

FIG. 1
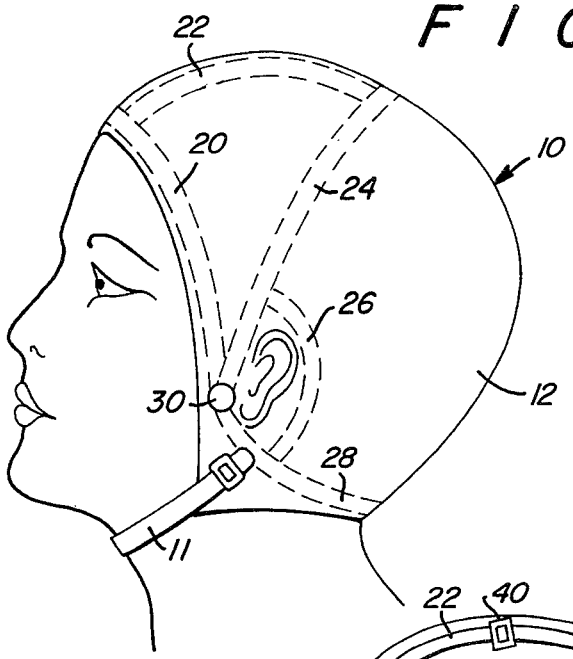
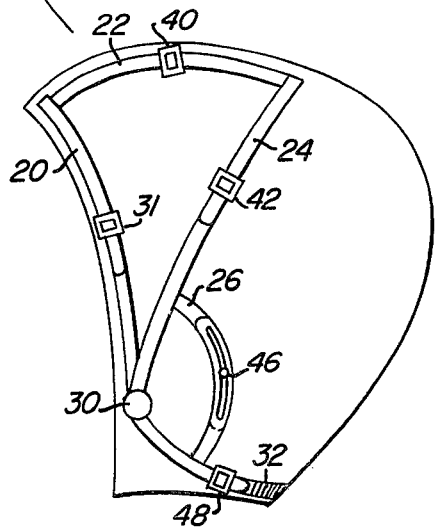
FIG. 2
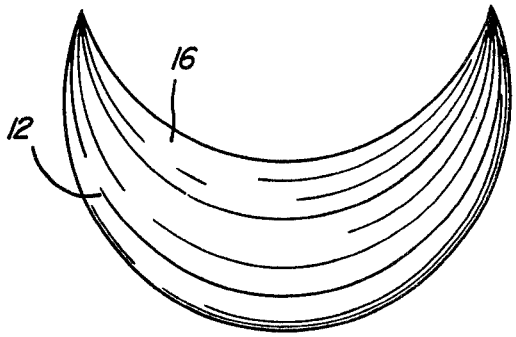
FIG. 3

BATHING CAP

This invention relates to bathing caps.

The primary purpose of a bathing cap is to protect the hair of the wearer from getting wet. All bathing caps are constructed of at least an outer protective covering composed of a material which will prevent direct liquid permeation through the covering. In addition, it is conventional for at least part of the covering to be elastic so as to accommodate the bathing cap to the head of the wearer and preferably to form a seal around the face and neck adjacent to the hairline. Due, however, to the differences in the shape and size of each persons head and the irregularity in head geometry it is difficult to maintain an effective seal between the edge of the cap and the head, particularly around the nape of the neck and the ears.

Various means have in the past been proposed for developing a more effective sealing arrangement at the mating edges between the cap and the head which will permit the cap to conform more accurately to the contour of the head of the wearer. Such means or devices range from the use of an inflatable band to the use of adhesive sealing strips. Other suggested means incorporate adjustable strps or strings which may be tightened as well as maneuvered in position to estabilish a pressurized seal. The prior art devices all have in common the integration of means for uniformly applying an equal pressure around the periphery of the head along a line conforming substantially to the hairline. In accordance with the teachings of the present invention the important consideration is not the uniformity of pressure but rather the establishment of an effective pressure seal which will not momentarily break upon flexing of the brow and/or by the natural movement of the head. A momentary or temporary break of the pressure seal is believed to occur from the tendency of the edge of the cap at the nape of the neck to rise or "creep" up the back of the neck upon flexing of the brow and by movement of the head particularly when the head is canted sideways or backwards. The seal may be only momentarily broken but during such period an open communicating passageway is provided for water penetration.

Accordingly, it is the principle object of the present invention to provide a bathing cap which minimizes the possibility of water seeping into the interior of the cap independent of movement of the head and flexing of brow.

A further object of the present invention is to provide a bathing cap which is initially adjustable to accommodate the cap to the unique size and shape of each wearer's head so as to seal off the head from any ingress of water.

Other objects and advantages of the present invention will become apparent from the following detailed description when taken in connection with the accompanying drawings of which:

FIG. 1 is an illustration of the bathing cap of the present invention in elevation and in a position on a head with portions of the inner adjustable framework shown in dotted lines;

FIG. 2 is a prospective side elevation of the adjustable inner framework of the bathing cap of FIG. 1; and FIG. 3 is an illustration of one embodiment of an outer protective covering for the bathing cap of the present invention.

Referring now to FIGS. 1–3 inclusive in which a bathing cap 10 is shown comprising an outer protective covering 12 preferably of an elastic closed cell rubber material and an inner framework 14 which is detachable from the outer covering 12. It is to be understood that the covering 12 may be worn on the outside of the protective covering although aesthetically undesirable. In addition, the outer covering 12 although preferably of a closed cell rubber material may be of any material which is water impervious. Moreover, an inner liner may be used to form a cushioned pad between the framework and the skin of the wearer. The inner framework 12 may be entirely or partially enclosed by the outer covering 12 without being integrally connected thereto. In such instance the outer protective covering 12 may, as illustrated in FIG. 3, be in the form of a collapsed sphere with a crescent shaped interior 16 forming an outer layer with an inverted inner layer. An incision is made in the inverted inner layer of sufficient length to permit the framework to be removably inserted by folding out the inverter layer and then reinverting it. Alternatively, the outer protective covering may have an internal flap which is folded out before positioning the framework 14 and then folded back to partially cover the framework 14. A further alternative would be to leave the framework 14 exposed from the interior side and connecting the framework to the outer covering 12 by the use of conventional means such as snap fasteners (not shown). It is to be understood that the present invention is not to be limited by the means for removably inserting or separating the outer covering 12 from the inner framework 14.

The framework 14 comprises a plurality of resilient strips of material 20, 22, 24, 26 and 28 respectively which are integrally connected to form upon adjustment a pressurized seal around the edge 30 of the cap 10. The strips may be composed of a material such as plastic, hard rubber or may be a composite. The strip 20 is substantially rigid having a parabolic curvature and is adapted to extend over the forehead from a predetermined location 30 on one side of the face below the cheekbone and above the anterior lobe of the ear to a substantially symmetrical location (not shown) on the other side of the face. Although rigid, the strip 20 should be sufficiently pliable to the extent that its radius of curvature may be altered by the normal application of force from either or both sides. This will provide the wearer with the ability to increase the pressure around the temple area on both sides of the head if necessary. In addition, the strip 20 should preferably be adjustable lengthwise around the forehead to accommodate different size heads. Where adjustability is provided by using a conventional fastener such as a buckle, the strip 20 would be formed by connecting two overlapping segments of strip material with the fastener. Other conventional adjustment means may also be used.

Strips 20 and 28 operate conjunctively to form the primary seal about the head of the wearer whereas strips 22, 24 and 26 represent respectively a secondary support to maintain the primary seal. Strip 28 extends around the nape of the neck and joins strip 20 at the junction 30 on one side of the face and at a substantially symmetrical junction location on the opposite side of the face (not shown). The connection forming each junction 30 is preferably a pivotal connection which may be formed with a conventional rivet or wafer about which the strips are adjustable. The strip 28 may be composed entirely of a flexible material or may be of a rigid but pliable material with at least one elastic portion 32 and a conventional adjustable fastening connection 38.

The two strips 20 and 28 are maintained juxtaposed upon the head in predetermined relation to one another by strips 22, 24 and 26, all of which are preferably rigid, although pliable, and all of which may be adjusted lengthwise by the use of conventional fasteners 40, 42 and 46 respectively. Strip 24 extends over the skull joining strips 20 and 28 at the pivotal connection location 30 on both sides of the head. Strip 22 maintains a predetermined separation between strips 20 and 24 whereas the strip 26 located on each side of the head acts as a brace for maintaining the separation between strips 24 and 28 and may be curved as shown in FIGS. 1 and 2 or straight. The strip 26 also serves the function of providing a secondary seal around each ear.

It should be understood that the cap may employ for further protection, a conventional neck strap 11 as shown in FIG. 1.

We claim:

1. A bathing cap adapted for emplacement over the head of a wearer to secure the head during periods of bathing from penetration by a surrounding liquid medium, having in combination an outer water impervious covering and an inner framework, said framework comprising:

a first resilient strip of material having a parabolic configuration and being adapted to extend around the forehead of the wearer from a first location on one side of the face near the ear to a second substantially symmetrical location on the opposite side of the face;

a second strip of material adapted to surround the nape of the wearer's neck;

means for pivotally connecting said first strip to said second strip at said first and second locations respectively; and means for maintaining a predetermined separation between said first and second strips, including brace means connected to said second strip of material on each side of the head about each ear and operatively connected to said first strip.

2. A bathing cap as defined in claim 1 further comprising means for adjusting the length of said first strip of material to accommodate different forehead sizes.

3. A bathing cap as defined in claim 2 wherein at least a portion of said second strip of material is elastic.

4. A bathing cap as defined in claim 3 wherein said framework is removably connected to said covering with the covering external to said framework.

5. A bathing cap as defined in claim 2 wherein said means for maintaining a predetermined separation between said first and second strip further comprises:

a third strip of flexible material having a substantially parabolic configuration adapted to extend over the head of said wearer between said pivotal connections;

means for separating said first strip from said third strip; and wherein said brace means extends from said second strip of material to said third strip of material for maintaining a predetermined separation between said second strip and said third strip.

6. A bathing cap as defined in claim 5 wherein said brace means comprises a first brace surrounding the posterior side of one ear and a second brace surrounding the posterior side of the opposite ear.

7. A bathing cap as defined in claim 6 wherein said first and second brace has a curved geometry.

8. A bathing cap as defined in claim 7 wherein said first and second brace has an underlayer of padding.

* * * * *